US009688519B2

(12) United States Patent
Kawabuchi et al.

(10) Patent No.: US 9,688,519 B2
(45) **Date of Patent: *Jun. 27, 2017**

(54) TELESCOPIC BOOM EXTENSION DEVICE

(71) Applicant: TADANO LTD., Kagawa (JP)

(72) Inventors: Naoto Kawabuchi, Sanuki (JP); Takashi Kawano, Sanuki (JP)

(73) Assignee: TADANO LTD., Kagawa (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/015,647

(22) Filed: Feb. 4, 2016

(65) Prior Publication Data

US 2016/0244306 A1 Aug. 25, 2016

(30) Foreign Application Priority Data

Feb. 24, 2015 (JP) ..... 2015-034570

(51) Int. Cl.
*B66C 23/06* (2006.01)
*B66C 23/70* (2006.01)
*B66C 23/22* (2006.01)

(52) U.S. Cl.
CPC ..... *B66C 23/705* (2013.01); *B66C 23/22* (2013.01)

(58) Field of Classification Search
CPC ..... B66C 23/705
USPC ..... 52/115, 118
See application file for complete search history.

(56) References Cited

U.S. PATENT DOCUMENTS 2,833,422 A * 5/1958 Ferwerda ..... E02F 3/286 212/349
3,624,979 A * 12/1971 Przybylski ..... B66C 23/705 212/231
4,459,786 A * 7/1984 Pitman ..... B66C 23/701 212/348
4,478,014 A * 10/1984 Poock ..... B66C 23/701 212/350
4,663,900 A * 5/1987 Rehm ..... H01Q 1/10 212/292
4,676,340 A * 6/1987 Correll, Jr. ..... B66F 11/046 182/2.11
4,688,690 A * 8/1987 Gattu ..... B66C 23/708 212/292
5,628,416 A 5/1997 Frommelt et al.
(Continued)

FOREIGN PATENT DOCUMENTS

JP H7-267584 A 10/1995
JP 4612144 B 1/2011
(Continued)

*Primary Examiner* — Charles A. Fox
*Assistant Examiner* — James Buckle, Jr.
(74) *Attorney, Agent, or Firm* — Brundidge & Stanger, P.C.

(57) ABSTRACT

A telescopic boom extension device includes a driving mechanism. The driving mechanism that drives B pins and a C pin includes a hydraulic supply part and a drive source generation part. The drive source generation part generates a predetermined hydraulic pressure at the hydraulic supply part based on a pneumatic pressure. The hydraulic supply part has an accumulator and AOHs and supplies a hydraulic pressure to a cylinder-boom coupling mechanism and an inter-boom fixing mechanism. The drive source generation part uses a pneumatic supply part to send compressed air to the hydraulic supply part.

6 Claims, 10 Drawing Sheets

(56) References Cited

U.S. PATENT DOCUMENTS

| | | | | |
|---|---|---|---|---|
| 7,497,140 | B2 * | 3/2009 | Blackwelder | F16H 25/20 52/118 |
| 2013/0220749 | A1 | 8/2013 | Stammen | |

FOREIGN PATENT DOCUMENTS

| | | | |
|---|---|---|---|
| JP | 4709415 | B | 6/2011 |
| JP | 2013-539525 | A | 10/2013 |

* cited by examiner

TELESCOPIC BOOM EXTENSION DEVICE

CROSS-REFERENCE TO RELATED APPLICATIONS

This application is based on and claims the benefit of priority from Japanese Patent Application No. 2015-034570, filed on Feb. 24, 2015, the entire contents of which are incorporated herein by reference.

BACKGROUND OF THE INVENTION

Technical Field

The present invention relates to a telescopic boom extension device for extending and retracting a telescopic boom mounted on a mobile crane.

Related Art

Mobile cranes such as a rough-terrain crane, for example, generally include a multistage telescopic boom. The telescopic boom is extended and retracted using a hydraulic cylinder in general. In particular, devices for extending and retracting a telescopic boom using a single double-acting hydraulic cylinder have been proposed (hereinafter, referred to as "extension device") (for example, refer to JP 7-267584 A, JP No. 4612144, and JP No. 4709415).

The extension device is structured as described below.

The multistage telescopic boom includes bottom-stage and top-stage booms so called the base boom and the top boom, respectively, and one or more booms placed between the foregoing booms, which are so called intermediate booms. When the telescopic boom includes a plurality of intermediate booms, the intermediate boom adjacent to the top boom is referred to as a first intermediate boom, and the other intermediate boom adjacent to the first mediate boom is referred to as a second intermediate boom while the other intermediate boom adjacent to the second intermediate boom is referred to as a third intermediate boom, and so forth. Each of the booms extends (slides forth) and retracts (slides back) relative to the adjacent boom and is kept by a boom fixing pin (hereinafter, referred to as "B pin") in the fully-retracted state and the fully-extended state. The B pins are provided between all the adjacent booms, and each of the B pins is elastically biased so as to fit to a corresponding one of the adjacent booms by a mechanical element such as a spring.

In the telescopic boom, the top boom is extended first, sequentially followed by the intermediate booms. One end portion (cylinder rod-side end portion) of the single hydraulic cylinder is coupled to the base end portion of the base boom. As described above, when the booms are in the fully-retracted state, the adjacent booms are coupled together always by the B pins. In this state, the cylinder tube of the hydraulic cylinder is coupled to the top boom. Specifically, the two are coupled together by a cylinder fixing pin (hereinafter, referred to as "C pin"). Unlike the B pins, the C pin is singly provided at the cylinder tube side, and is coupled to the top boom when the telescopic boom is in the fully-retracted state. As with the B pins, the C pin is elastically biased toward the telescopic boom by a mechanical element such as a spring such that the C pin always engages with the telescopic boom.

When the B pin coupling the top boom and the first intermediate boom is driven to decouple the two booms, the top boom becomes slidable relative to the first intermediate boom. When the hydraulic cylinder extends in this state, the top boom extends together with the cylinder tube relative to the first intermediate boom.

When the top boom enters in the fully-extended state relative to the first intermediate boom, the driving of the B pin is stopped and the top boom and the first intermediate boom are coupled together again by the B pin. Then, when the C pin coupling the top boom and the hydraulic cylinder is driven to decouple the boom and cylinder, the hydraulic cylinder is retracted. At that time, only the cylinder tube slides. When the cylinder tube moves to a predetermined position relative to the first intermediate boom, the driving of the C pin is stopped, and the C pin engages with the first intermediate boom to couple the cylinder tube and the first intermediate boom. Subsequently, the B pin coupling the first intermediate boom and the second intermediate boom is driven to decouple the two booms, and the hydraulic cylinder is extended. Accordingly, the second intermediate boom extends relative to the third intermediate boom. In this manner, each of the booms extends sequentially relative to the adjacent boom, and the entire telescopic boom is finally in the fully-extended state. In the reversed manner, the telescopic boom is retracted.

The B pins and the C pin are driven by the hydraulic actuator placed inside the boom. However, the B pins and the C pin are configured not to be driven all the time but to be driven only when coupling using the B pins and the C pin is to be cancelled as described above. That is, the hydraulic actuator is configured not to operate all the time but to operate temporarily only when the B pins and the C pin are to be removed for extension and retraction of the telescopic boom. Therefore, the flow amount of operating oil necessary for driving the B pins and the C pin is small. For this reason, according to the related art, an accumulator is e used as a drive source for the B pins and the C pin in some cases (for example, refer to JP 2013-539525 A).

SUMMARY OF THE INVENTION

In the extension device according to the related art, the accumulator is placed inside the top boom, and an accumulation unit for accumulating pressure in the accumulator is attached to the cylinder tube. The accumulation unit is configured to accumulate pressure in the accumulator using the pressure of a retraction-side port when the hydraulic cylinder retracts and thus can be designed to be compact.

However, the circuit for accumulating pressure in the accumulator using the pressure generated in the hydraulic cylinder during operation is formed in the limited space around the cylinder tube, and it is thus not easy to maintain the extension device. In addition, the circuit is complicated in structure to cause the problems of increasing manufacturing costs and time necessary for recovery from failure.

The present invention has been made in view of such circumstances and aims to provide a low cost and easy-to-maintain telescopic boom extension device capable of smooth driving of the B pins and the C pin.

(1) A telescopic boom extension device according to an aspect of the present invention is applied to a telescopic boom in which a base boom, an intermediate boom inserted into the base boom, and a top boom inserted into the intermediate boom constitute a telescopic structure, a boom fixing member is provided to couple an adjacent pair of the booms when the adjacent booms are in a fully-extended state or a fully-contracted state, and when a single built-in extension cylinder extends or retracts, the extension cylinder is coupled selectively to the top boom and the intermediate boom in sequence via a cylinder fixing member to extend the top boom and the intermediate boom in sequence. The telescopic boom extension device includes: a hydraulic supply part that includes: an accumulator configured to supply operating oil under a predetermined pressure to a first hydraulic actuator and a second hydraulic actuator; and an air over hydraulic booster (AOH) configured to accumulate pressure in the accumulator, the first and the second hydraulic actuators being configured to drive the boom fixing member and the cylinder fixing member, respectively, the hydraulic supply part being placed in the vicinity of the extension cylinder. In addition, the telescopic boom extension device includes a drive source generation part that includes a pneumatic supply part configured to supply a pneumatic pressure and that is configured to generate operating oil under a predetermined pressure at the hydraulic supply part based on the pneumatic pressure.

According to this configuration, when the telescopic boom is extended, the boom fixing member and the cylinder fixing member are driven by the first hydraulic actuator and the second hydraulic actuator, respectively. These hydraulic actuators use the accumulator as a drive source, which allows the hydraulic supply part to be simple and compact in structure. In addition, the pressure is accumulated in the accumulator by the drive source generation part and the AOH operating based on the pneumatic pressure. That is, the pressure is accumulated in the accumulator by the combined functioning of the pneumatic mechanism and the hydraulic mechanism. Therefore, the structure of pressure accumulation is very simple as compared to the structure according to the related art in which the pressure is accumulated in the accumulator by the working pressure of the extension cylinder.

In addition, the hydraulic supply part is placed in the vicinity of the extension cylinder, and the circuit length of the hydraulic supply part becomes very short and the reduction in the operational responsiveness of the first hydraulic actuator and the second hydraulic actuator resulting from a change in the viscosity of the operating oil becomes very small. Further, the drive source generation part supplies the pneumatic pressure to the hydraulic supply part, and the pressure loss of the air with a change in the environmental temperature is small even in a case where the distance from the hydraulic supply part is long. The operational responsiveness of the first hydraulic actuator and the second hydraulic actuator are not affected in this case. Therefore, the drive source generation part does not need to be increased in size taking into account the pressure loss of the air, thereby achieving a reduction in weight and size.

(2) It is preferred that the telescopic boom extension device further include a pressure sensor configured to detect internal pressure in the accumulator and a control unit configured to operate the drive source generation part to activate the AOH, when determining that the internal pressure is equal to or lower than a specific value based on an output signal from the pressure sensor.

According to this configuration, once the pressure in the accumulator becomes equal to or lower than the specific value, pressure is automatically accumulated in the accumulator. Therefore, the first hydraulic actuator and the second hydraulic actuator can be operated reliably when needed.

(3) It is preferred that the AOH include an air cylinder including an air piston and an air tube, in which the air piston is slidable relative to the air tube without being biased in any direction.

The AOH constitutes a closed circuit as a hydraulic circuit. For example, when the environmental temperature changes to raise the pressure in the operating oil, the air cylinder is in a freely movable state, so that a piston in the hydraulic cylinder pairing off with the air cylinder is easily displaceable. That is, making the air cylinder into the freely movable state would perform the function as if the hydraulic cylinder is provided with a reservoir tank. Therefore, it is not necessary to provide a separate reservoir tank at the AOH, thereby reducing the weight and size of the AOH structure, that is, the hydraulic supply part.

(4) A telescopic boom extension device according to an aspect of the present invention is applied to a telescopic boom in which a base boom, an intermediate boom inserted into the base boom, and a top boom inserted into the intermediate boom constitute a telescopic structure, a boom fixing member is provided to couple an adjacent pair of the booms when the adjacent booms are in a fully-extended state or a fully-retracted state, and when a single built-in extension cylinder extends or retracts, the extension cylinder is coupled selectively to the top boom and the intermediate boom in sequence via a cylinder fixing member to extend the top boom and the intermediate boom in sequence. The telescopic boom extension device includes: a hydraulic supply part that includes: an air over hydraulic booster (AOH) configured to supply operating oil under a predetermined pressure to a first hydraulic actuator and a second hydraulic actuator; and an air tank unit configured to supply compressed air to the AOH, the first and the second hydraulic actuators being configured to drive the boom fixing member and the cylinder fixing member, respectively, the hydraulic supply part being placed in the vicinity of the extension cylinder. In addition, the telescopic boom extension device includes a drive source generation part that includes a pneumatic supply part configured to supply a pneumatic pressure and that is configured to fill the air tank unit with compressed air based on the pneumatic pressure.

According to this configuration, when the telescopic boom is extended, the boom fixing member and the cylinder fixing member are driven by the first hydraulic actuator and the second hydraulic actuator, respectively. These hydraulic actuators use the AOH and the air tank unit as a drive source, so that the structure of the hydraulic supply part can be simple and compact. In addition, the air tank unit is filled with the compressed air by the drive source generation part operating based on the pneumatic pressure. That is, the structure is very simple as compared to the structure according to the related art in which the pressure is accumulated in the accumulator by the working pressure of the extension cylinder.

In addition, the hydraulic supply part is placed in the vicinity of the extension cylinder, so that the circuit length of the hydraulic supply part becomes very short and the reduction in the operational responsiveness of the first hydraulic actuator and the second hydraulic actuator resulting from a change in the viscosity of the operating oil becomes very small. Further, the drive source generation part supplies the compressed air to the air tank unit, and the pressure loss of the air with a change in the environmental temperature is small even in a case where the distance from the air tank unit is long. The operational responsiveness of the first hydraulic actuator and the second hydraulic actuator is not affected in this case. Therefore, the drive source generation part does not need to be large in size allowing for the pressure loss of the air, thereby achieving a reduction in weight and size.

(5) It is preferred that the extension device for telescopic boom further include a pressure sensor configured to detect a filling pressure in the air tank unit and a control unit configured to operate the drive source generation part to fill the air tank unit with compressed air, when determining that the filling pressure is equal to or lower than a specific value based on an output signal from the pressure sensor.

According to this configuration, once the filling pressure in the air tank unit becomes equal to or lower than a specific value, the air tank unit is automatically filled with compressed air. Therefore, the first hydraulic actuator and the second hydraulic actuator can operate reliably when necessary.

(6) It is preferred that the AOH include an air cylinder including an air piston and an air tube, in which the air piston is slidable relative to the air tube without being biased in any direction.

The AOH constitutes a closed circuit as a hydraulic circuit. When the environmental temperature changes to raise the pressure in the operating oil, for example, since the air cylinder is in the freely movable state, a piston in the hydraulic cylinder pairing off with the air cylinder is easily displaceable. That is, placing the air cylinder in the freely movable state would perform the function as if the hydraulic cylinder is provided with a reservoir tank. Therefore, it is not necessary to provide a separate reservoir tank at the AOH, thereby reducing the weight and size of the AOH structure, that is, the hydraulic supply part.

The present invention provides a low-cost and easy-to-maintain telescopic boom extension device capable of smooth driving of the boom fixing member and the cylinder fixing member.

DESCRIPTION OF THE EMBODIMENTS

Hereinafter, a preferred embodiment of the present invention will be described with reference as appropriate to the drawings. However, this embodiment is merely one mode of a telescopic boom extension device according to the present invention. As a matter of course, the embodiment can be modified without deviating from the gist of the present invention.

<Schematic Configuration and Features>

Figure 1:
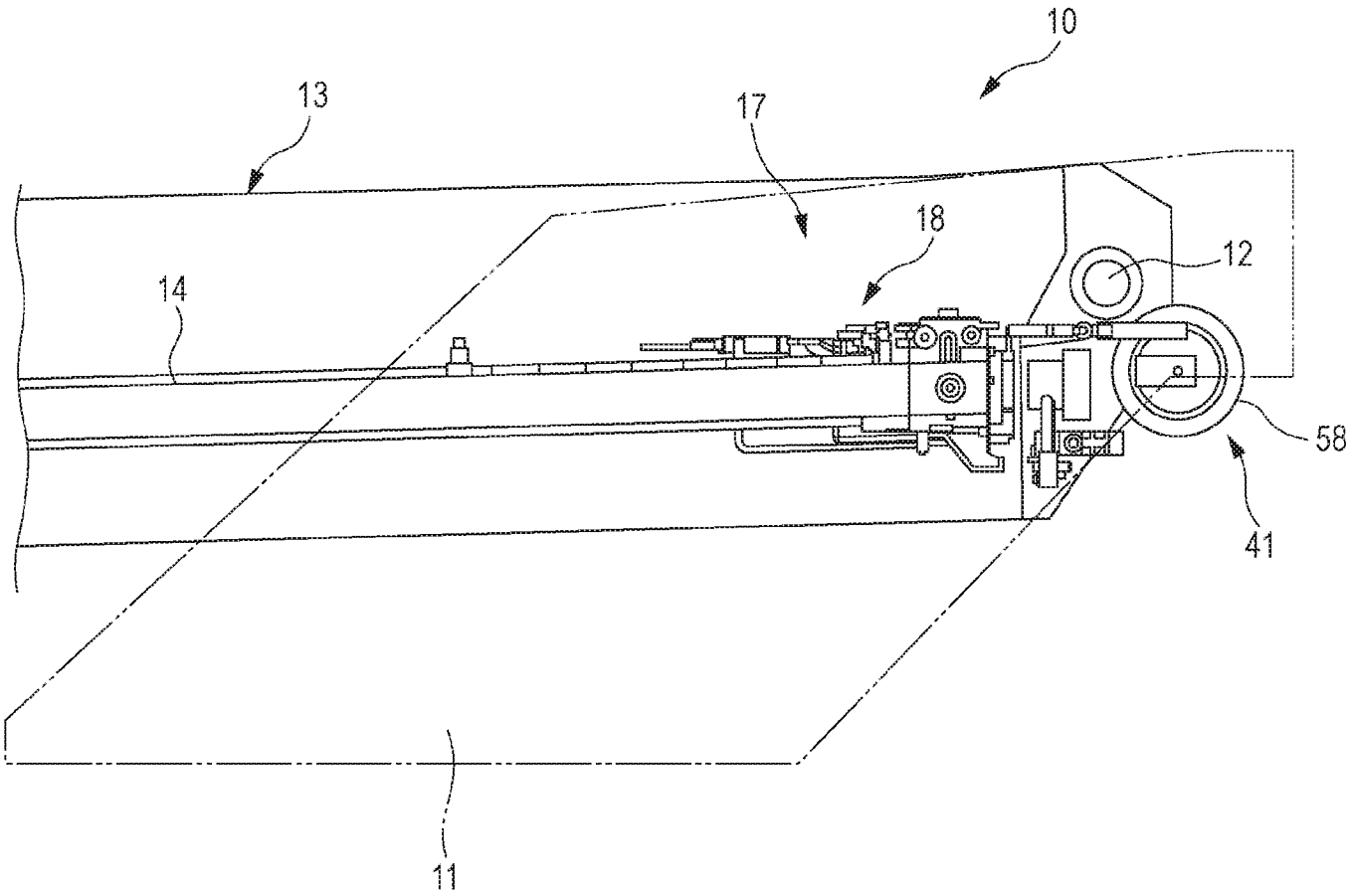
FIG. 1 is an enlarged view of main components of a mobile crane employing a telescopic boom extension device according to an embodiment of the present invention.

FIG. 1 is an enlarged view of main components of a mobile crane (typically, a rough-terrain crane) employing a telescopic boom extension device 10 according to an embodiment of the present invention.

As illustrated in the drawing, the mobile crane includes a turning base 11, and a telescopic boom 13 is supported on the turning base 11 via a derrick central shaft 12. As described hereinafter in detail, the telescopic boom 13 includes a plurality of cylindrical booms that constitute a telescopic structure. The telescopic boom 13 is rotatable around the derrick central shaft 12 and performs a derricking action by extension and retraction of a derrick cylinder not illustrated. A single extension cylinder 14 is mounted in the telescopic boom 13 such that, as the extension cylinder 14 extends and retracts, the telescopic boom 13 extends and retracts longitudinally in a manner described, hereinafter.

Figure 2:
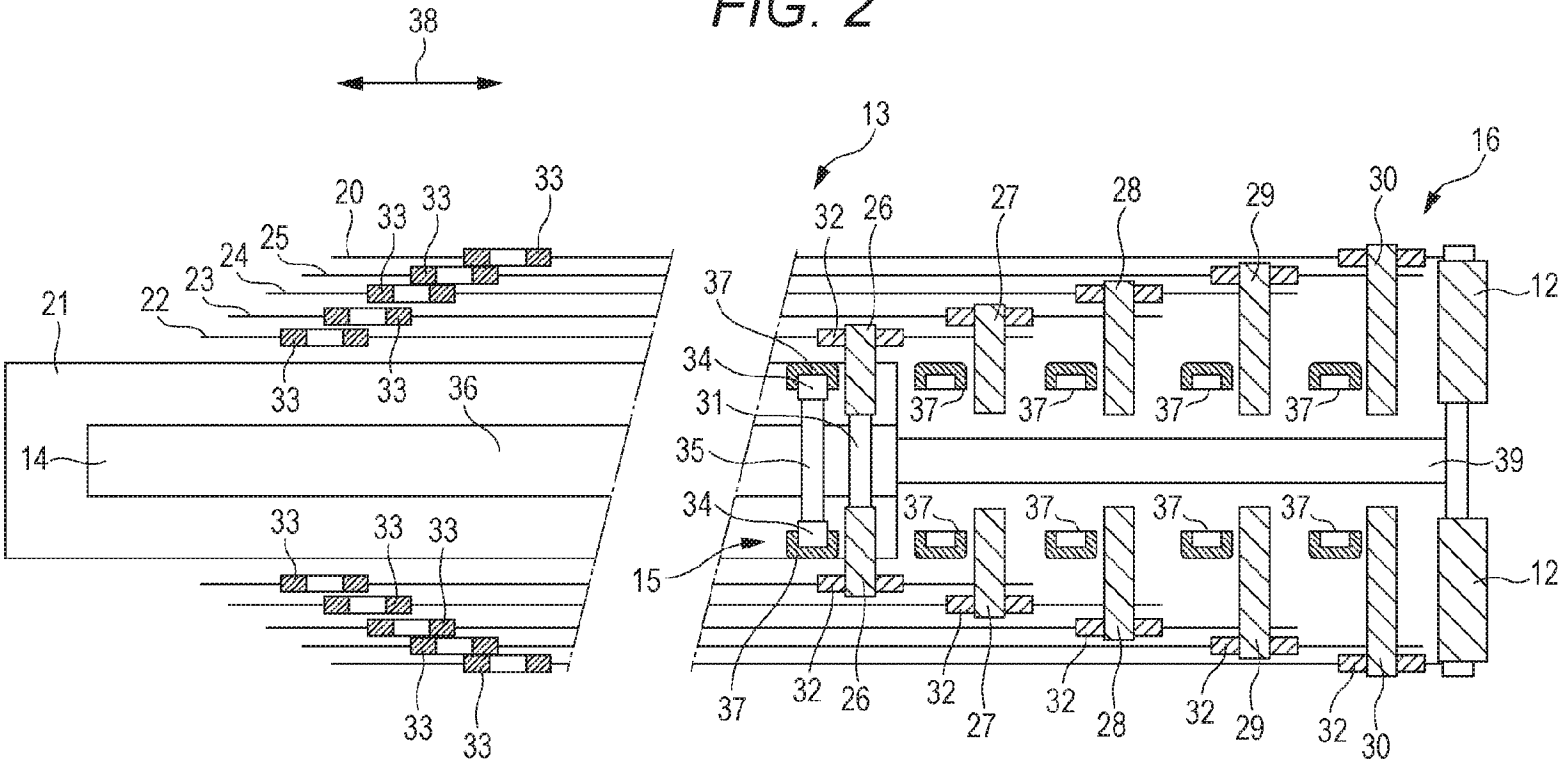
FIG. 2 is a schematic view showing a structure of a telescopic boom according to the embodiment of the present invention.

FIG. 2 is a schematic view showing a structure of the telescopic boom 13 according to the embodiment of the present invention.

As illustrated in FIGS. 1 and 2, a telescopic boom extension device (hereinafter, referred simply to as "extension device") 10 includes: the telescopic boom 13; the extension cylinder 14 that extends and retracts the telescopic boom 13; a cylinder-boom coupling mechanism 15 that couples the extension cylinder 14 to a predetermined part of the telescopic boom 13; an inter-boom fixing mechanism 16 that couplies adjacent booms among a plurality of booms constituting the telescopic boom 13; a driving mechanism 17 (see FIG. 1) that drives the cylinder-boom coupling mechanism 15 and the inter-boom fixing mechanism 16; and a controller 72 that controls operations of the driving mechanism 17 (see FIG. 6: equivalent to a "control unit" described in the claims).

Figure 3:
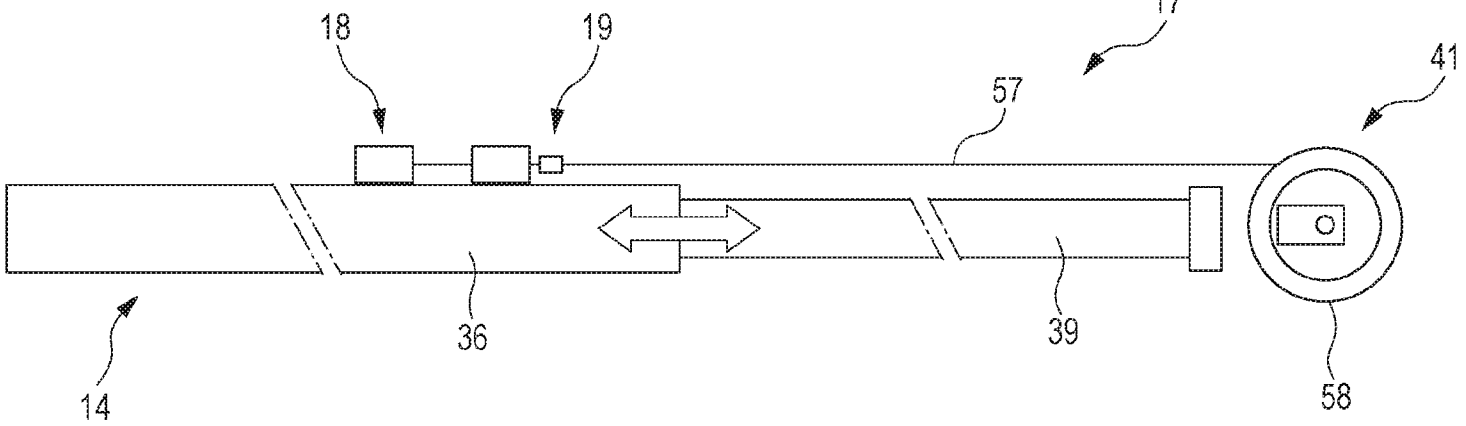
FIG. 3 is a schematic diagram showing a structure of a driving mechanism according to the embodiment of the present invention.

FIG. 3 is a schematic diagram showing a structure of the driving mechanism 17.

The extension device 10 according to this embodiment is characterized by the structure of the driving mechanism 17. As illustrated in FIGS. 1 and 3, the driving mechanism 17 includes a hydraulic supply part 18 and a drive source generation part 19 to be described hereinafter in detail. The drive source generation part 19 generates a predetermined hydraulic pressure at the hydraulic supply part 18 based on a pneumatic pressure. The hydraulic supply part 18 has an accumulator 75 (see FIG. 6) and air over hydraulic boosters (AOHs) 51 (see FIG. 6), and supplies in a manner to be described hereinafter a hydraulic pressure to the cylinder-boom coupling mechanism 15 and the inter-boom fixing mechanism 16 (see FIG. 2) to operate the two mechanisms. The drive source generation part 19 employs a pneumatic supply part 41 to be described hereinafter to send compressed air to the hydraulic supply part 18.

Specifically, the driving mechanism 17 converts a pneumatic pressure into a hydraulic pressure and accumulates the hydraulic pressure in the accumulator 75, and drives the cylinder-boom coupling mechanism 15 and the inter-boom fixing mechanism 16 with the accumulator 75 as a hydraulic source. Thus, ease of maintenance of the driving mechanism 17 can be improved while the driving mechanism 17 is reduced in weight, size, and cost.

<Operations of the Telescopic Boom>

As illustrated in FIG. 2, the telescopic boom 13 includes a base boom 20, a top boom 21, and four intermediate booms 22 to 25 between the base and top booms. The intermediate booms 22 to 25 will be called first, second, third and fourth intermediate booms 22, 23, 24 and 25, respectively, in sequence from the intermediate boom adjacent to the top boom 21. That is, in this embodiment, the telescopic boom 13 has a six-stage structure. The telescopic boom 13 is assembled such that the booms 21 to 25 slide in a longitudinal direction 38 from the base boom 20, thereby constituting a telescopic structure as described above. However, the telescopic boom 13 does not have to be a six-stage telescopic boom, and there is no specific limitation on the number of intermediate booms.

In this embodiment, the single extension cylinder 14 is built in the telescopic boom 13. The extension cylinder 14 is a hydraulic double-acting cylinder, and the leading end portion of a cylinder rod 39 is coupled to the base end of the base boom 20. The extension cylinder 14 is placed along the telescopic boom 13 in the longitudinal direction 38, and a cylinder tube 36 is placed inside the top boom 21 in the state illustrated in FIG. 2. The operation to extend and retract the extension cylinder 14 causes the extension cylinder 14 to extend and retract in a manner described hereinafter.

FIG. 2 illustrates the telescopic boom 13 in the fully-retracted state. In this state, the adjacent booms are constantly coupled together by the inter-boom fixing mechanism 16.

Figure 4:
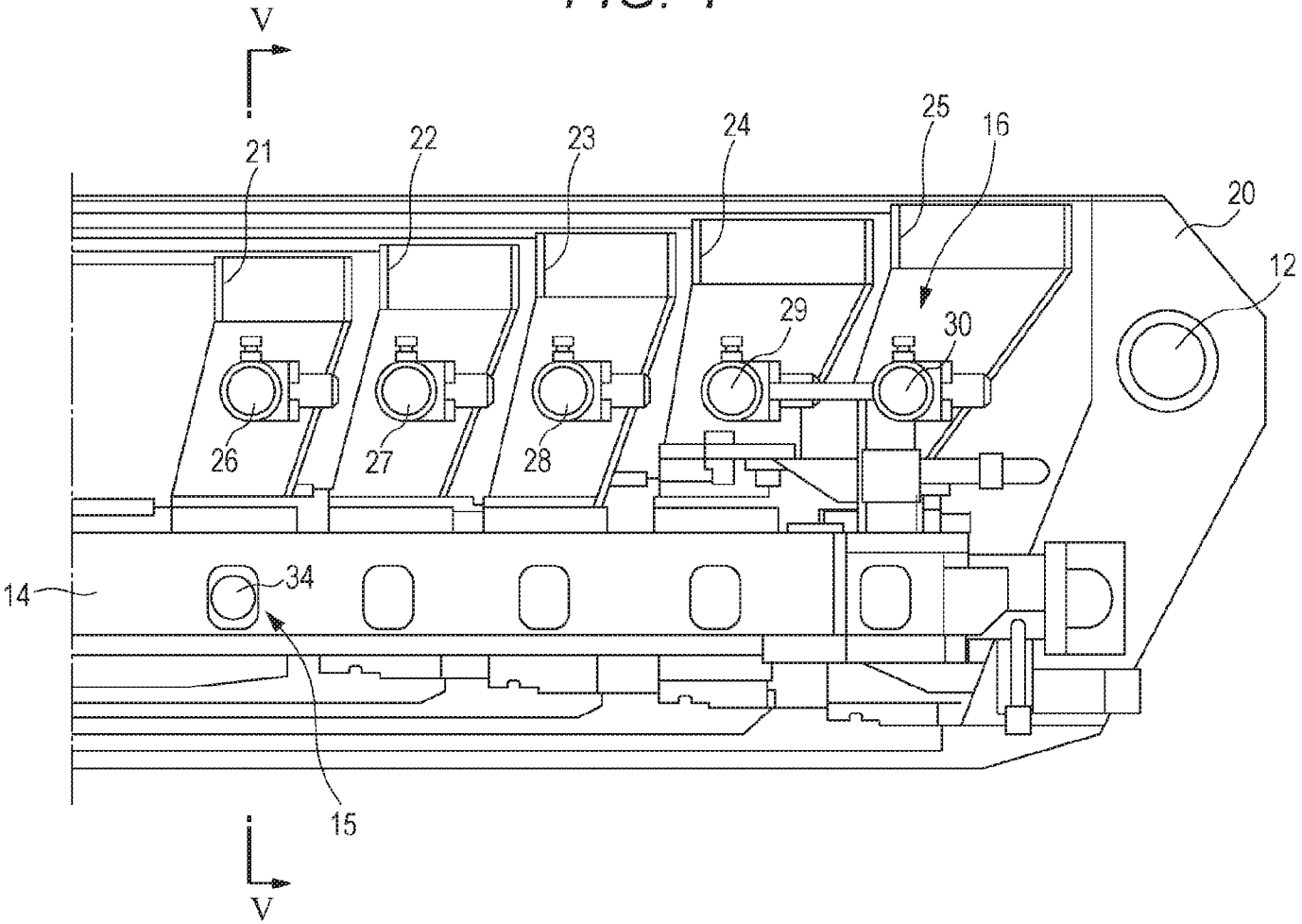
FIG. 4 is a vertical cross-sectional view of the telescopic boom according to the embodiment of the present invention.
Figure 5A:
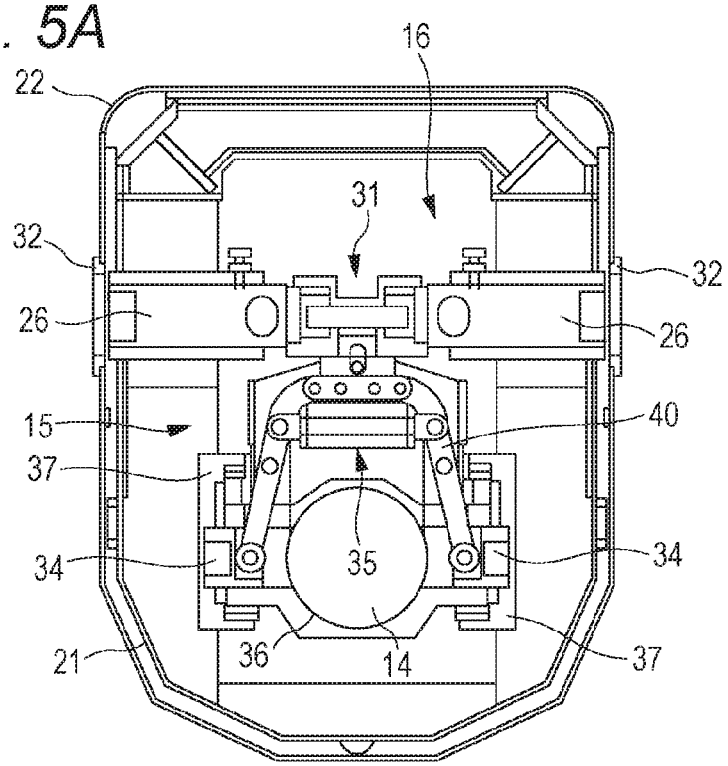
FIGS. 5A and 5B are cross-sectional views of the telescopic boom taken along plane V-V in FIG. 4.
Figure 5B:
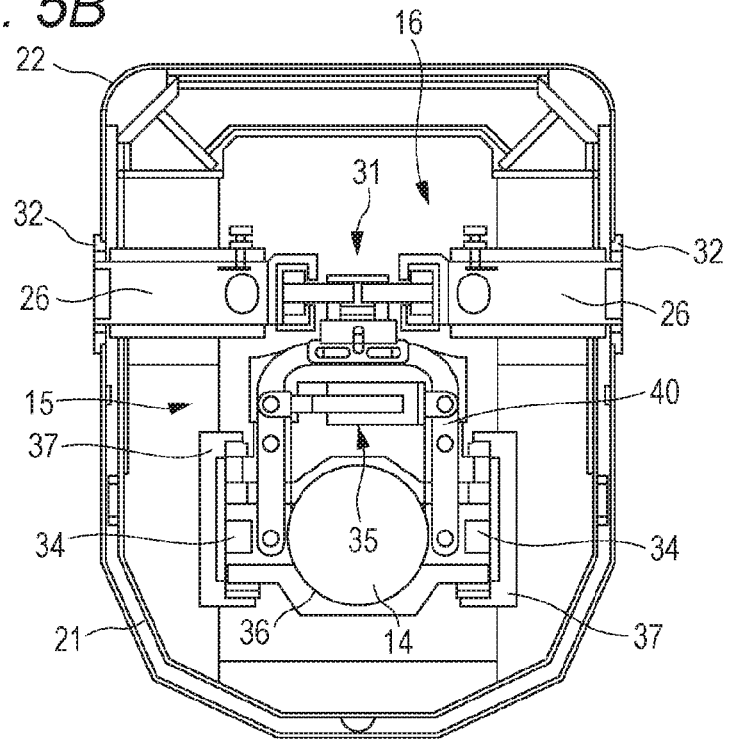

FIG. 4 is a vertical cross-sectional view of the telescopic boom 13, and FIGS. 5A and 5B are lateral cross-sectional views of the same, respectively. FIGS. 5A and 5B are cross-sectional views of the telescopic boom 13 taken along V-V plane in FIG. 4. The drawings show schematically structures of the cylinder-boom coupling mechanism 15 and the inter-boom fixing mechanism 16.

As illustrated in FIGS. 2, 4, and 5A and 5B, the inter-boom fixing mechanism 16 includes five pairs of boom fixing pins (equivalent to a "boom fixing member" described in the claims and hereinafter referred to as "B pins") 26 to 30 and a hydraulic cylinder 31 (equivalent to a "first hydraulic actuator" described in the claims) that drives the fixing pins 26 to 30. The structure of the inter-boom fixing mechanism 16 is known. The B pins 26 penetrate through the top boom 21 and first intermediate boom 22 adjacent to each other to regulate the relative sliding of the two booms. As illustrated in FIGS. 2, 5A, and 5B, the B pins 26 are provided on the top boom 21 side and moves forward or backward relative to the first intermediate boom 22 to penetrate through the first intermediate boom 22 or separate from the first intermediate boom 22. In the normal state, the B pins 26 are biased toward the first intermediate boom 22 by a spring not illustrated. The portions of the first intermediate boom 22 through which the B pins 26 penetrate are the base end portion and the leading end portion where bosses 32 and 33 are provided, and the B pins 26 are to be inserted into the bosses 32 and 33 (see FIG. 2). The portions of the first intermediate boom 22 where the bosses 32 or 33 are provided are where the B pins 26 face when the top boom 21 is brought into the fully-retracted state or the fully-extended state relative to the first intermediate boom 22. That is, the top boom 21 and the first intermediate boom 22 are coupled and fixed by the B pin 26 when the top boom 21 is in the fully-retracted state or the fully-extended state relative to the first intermediate boom 22. As illustrated in FIGS. 5A and 5B, when the hydraulic cylinder 31 is activated, the B pins 26 are pulled out of the first intermediate boom 22. Accordingly, the top boom 21 becomes slidable relative to the first intermediate boom 22. The B pins 27 to 30 behave in the same manner as the B pins 26.

As illustrated in FIGS. 2, 4, 5A, and 5B, the cylinder-boom coupling mechanism 15 includes cylinder coupling pins (equivalent to a "cylinder fixing member" described in the claims, and hereinafter, referred to as "C pins") 34 and a hydraulic cylinder 35 (equivalent to a "second hydraulic actuator" described in the claims) that drives the C pins 34. The structure of the cylinder-boom coupling mechanism 15 is known. The C pins 34 are provided at the cylinder tube 36 side of the extension cylinder 14, and are constantly fitted to the top boom 21 in the state illustrated in FIG. 2. As illustrated in FIGS. 5A and 5B, the hydraulic cylinder 35 includes a link mechanism 40. When the hydraulic cylinder 35 is activated, the link mechanism 40 slides the C pins 34 in the right and left direction in FIGS. 5A and 5B. In the normal state, the C pin 34 is biased toward the top boom 21 by a spring not illustrated. Bosses 37 are provided at the base end portion of the top boom 21, and the C pins 34 are fitted to the bosses 37. When the hydraulic cylinder 35 is activated, the C pins 34 are pulled toward the extension cylinder 14 via the link mechanism 40. When the C pins 34 are pulled out of the bosses 37, the extension cylinder 14 is mechanically separated from the top boom 21. That is, the extension cylinder 14 is coupled to the top boom 21 in the normal state, but the extension cylinder 14 becomes slidable relative to the telescopic boom 13 when the hydraulic cylinder 35 is activated. The bosses 37 are also provided at each of the base end portions of the intermediate booms 22 to 25. The C pin 34 can be selectively coupled to the intermediate booms 22 to 25 in a manner described hereinafter.

FIG. 5A illustrates the state in which the B pins 26 are pulled out of the first intermediate boom 22 and the C pins 34 are coupled to the top boom 21. FIG. 5B illustrates the state in which the B pins 26 are coupled to the first intermediate boom 22 and the C pins 34 are pulled out of the top boom 21.

When the extension cylinder 14 extends in the state of FIG. 5A, the top boom 21 slides together with the cylinder tube 36 of the extension cylinder 14 leftward in the direction of arrow 38 relative to the first intermediate boom 22 as illustrated in FIG. 2. When the extension cylinder 14 extends up to the position of the first intermediate boom 22 where the B pins 26 face the bosses 33, the hydraulic cylinder 31 is deactivated, and the B pins 26 return to the first intermediate boom 22 side because of the spring and fit to the bosses 33. Accordingly, the first intermediate boom 22 and the top boom 21 are fixed to each other while the top boom 21 is in the fully-extended state relative to the first intermediate boom 22. Then, as illustrated in FIG. 5B, the hydraulic cylinder 35 is activated to decouple the C pins 34 from the top boom 21 via the link mechanism 40. That is, the C pins 34 are pulled out of the bosses 37 of the top boom 21. When the extension cylinder 14 retracts in that state, only the cylinder tube 36 moves toward the base end of the base boom 20 (rightward in FIG. 2).

Meanwhile, the hydraulic cylinder 35 remains activated to keep the C pins 34 in the state of FIG. 5B. When the extension cylinder 14 retracts to move the C pins 34 down to the position of the bosses 37 provided at the first intermediate boom 22, the retraction of the extension cylinder 14 is stopped while the hydraulic cylinder 35 is deactivated, and the C pins 34 are coupled to the bosses 37 of the first intermediate boom 22 as illustrated in FIG. 5A. Subsequently, when the first intermediate boom 22 is to be extended, the same action as in the case of the top boom 21 is performed. Similarly, the second, the third, and the fourth intermediate booms 23, 24, and 25 are extended in sequence. When the telescopic boom 13 is to be retracted, the foregoing actions are reversely performed.

<Drive Circuit and Controller of the Extension Device>

Figure 6:
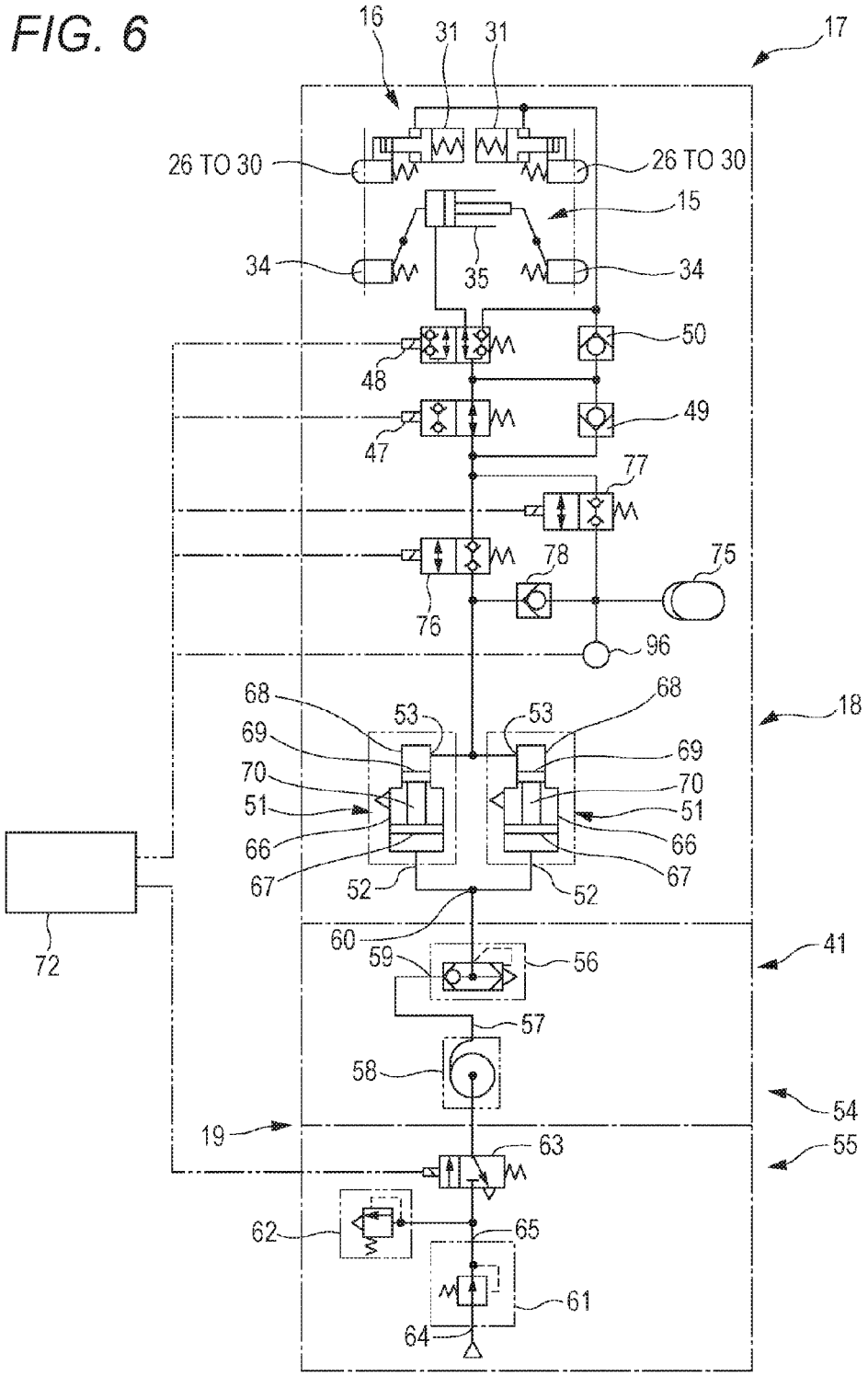
FIG. 6 is a circuit system diagram of the driving mechanism according to the embodiment of the present invention.

FIG. 6 is a circuit system diagram of the driving mechanism 17.

The driving mechanism 17 drives the cylinder-boom coupling mechanism 15 and the inter-boom fixing mechanism 16 as described above. As illustrated in FIG. 6, the driving mechanism 17 according to this embodiment includes the hydraulic supply part 18 and the drive source generation part 19, and the drive source generation part 19 operates with compressed air as a working fluid. That is, the driving mechanism 17 is a hydraulic-pneumatic composite system.

The hydraulic supply part 18 includes electromagnetic switching valves 47 and 48, check valves 49 and 50, electromagnetic switching valves 76 and 77, a check valve 78, the accumulator 75, and a pair of air over hydraulic boosters (AOHs) 51. These components are connected to the hydraulic cylinders 31 and 35. The boom fixing pins 26 to 30 and the cylinder coupling pins 34 are driven by the hydraulic cylinder 31 and the hydraulic cylinder 35 as described above. The hydraulic supply part 18 constitutes a so-called closed circuit together with the hydraulic cylinders 31 and 35, which is provided at the cylinder tube 36 of the extension cylinder 14. Each of the AOHs 51 has a pneumatic input port 52 and a hydraulic output port 53, and outputs from the hydraulic output port 53 a predetermined hydraulic pressure corresponding to the pneumatic pressure input into the pneumatic input port 52. The accumulator 75 is connected to the hydraulic output ports 53 via the check valve 78. The working pressure of the accumulator 75 can be set to various values and is set to 10 MPa in this embodiment.

In this embodiment, each of the AOHs 51 includes an input cylinder 66 (equivalent to an "air tube" described in the claims), an air piston 67, an output cylinder 68, and a hydraulic piston 69. The pneumatic input port 52 is provided at the input cylinder 66, and the hydraulic output port 53 is provided at the output cylinder 68. The air piston 67 and the hydraulic piston 69 are coupled together by a main shaft 70 and slide in an integrated manner. In this embodiment, the air piston 67 is held in a freely movable state within the input cylinder 66. Specifically, the air piston 67 is held only by frictional force generated between the air piston 67 and the hydraulic piston 69 in the input cylinder 66. That is, the air piston 67 is in the freely movable state and is not biased in any direction within the input cylinder 66. The advantage of the air piston 67 being freely movable without any biasing force will be described hereinafter.

The drive source generation part 19 includes: a pneumatic supply part 41 including a pneumatic supply unit 54; and a control valve unit 55.

The pneumatic supply unit 54 includes a quick release valve 56, an air hose 57, and a hose reel 58. The quick release valve 56 has an input port 59 and an output port 60. The output port 60 is connected to the pneumatic input ports 52 of the AOHs 51. The air hose 57 is cut into a predetermined length and wound around the hose reel 58 in an unrollable manner. In this embodiment, the hose reel 58 is attached to the back part of the turning base 11 as illustrated in FIGS. 1 and 3. The length of the air hose 57 is set as appropriate, and in this embodiment, the length of the air hose 57 corresponds to the stroke of the extension cylinder 14. The pneumatic supply part 41 includes a pneumatic source not illustrated. The pneumatic source may be an air tank included in the mobile crane, for example. The pressure of the pneumatic source is 1 MPa, for example. In this embodiment, the pressure of the compressed air supplied to the pneumatic supply unit 54 is set to 1 MPa, but is not limited to this value. The pressure of the pneumatic source can be set as appropriate as far as the outputs of the AOHs 51 are 10 MPa.

The control valve unit 55 includes pressure control valves (pressure reducing valve 61 and relief valve 62) and an electromagnetic switching valve 63. The pneumatic source is connected to an input port 64 of the pressure reducing valve 61, and the electromagnetic switching valve 63 is connected to an output port 65 of the same. The relief valve 62 is provided between the pressure reducing valve 61 and the electromagnetic switching valve 63.

The controller 72 controls operations of the drive source generation part 10 and the hydraulic supply part 18, specifically, operations of the electromagnetic switching valves arranged at the control valve unit 55 and the hydraulic supply part 18.

Figure 7:
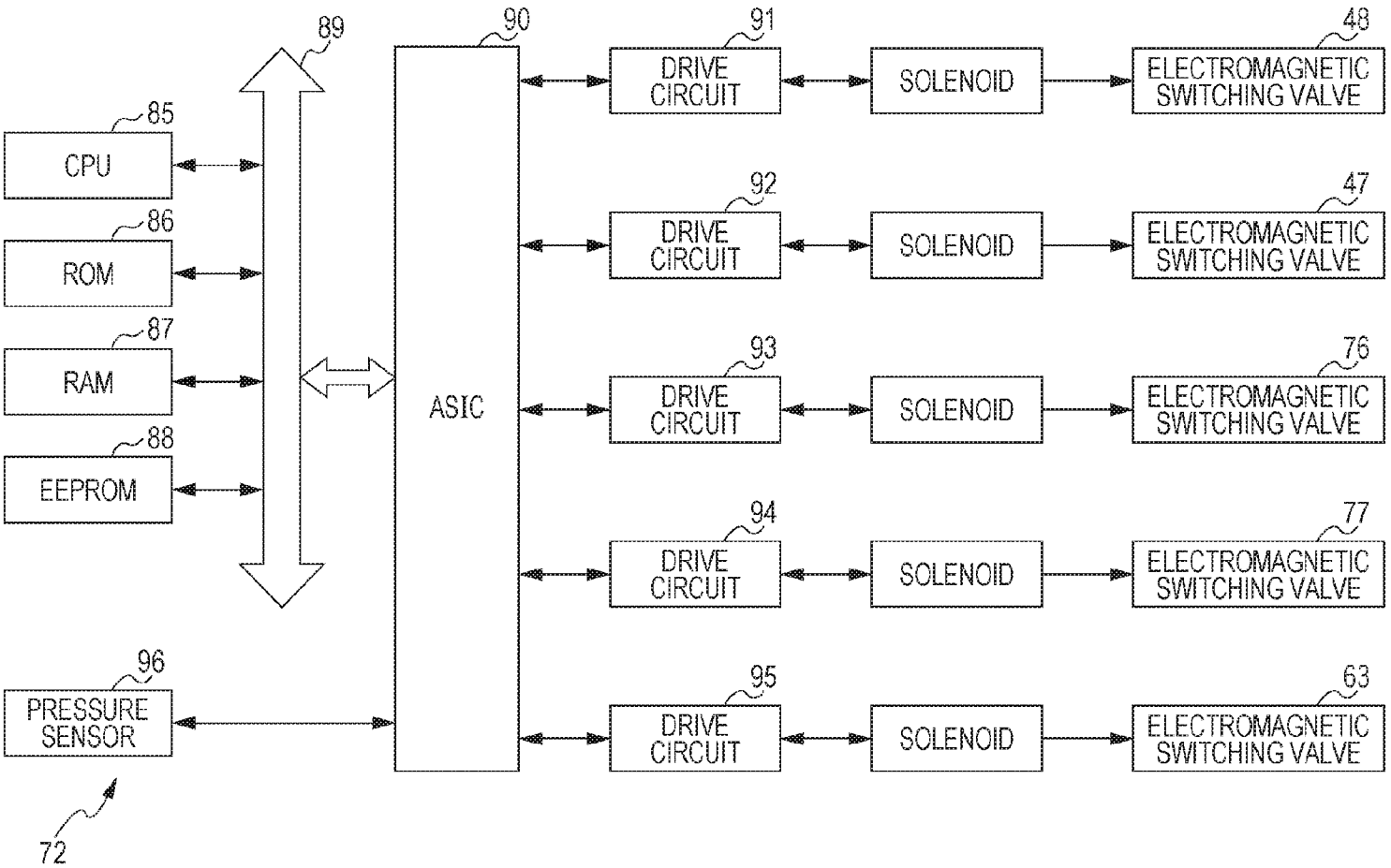
FIG. 7 is a block diagram of a controller according to the embodiment of the present invention.

FIG. 7 is a block diagram illustrating a configuration of the controller 72.

As illustrated in FIG. 7, the controller 72 is configured of a microcomputer mainly composed of a Central Processing Unit (CPU) 85, a Read Only Memory (ROM) 86, a Random Access Memory (RAM) 87, and an Electrically Erasable and Programmable ROM (EEPROM) 88. The controller 72 is connected to an Application Specific Integrated Circuit (ASIC) 90 via a bus 89.

The ROM 86 stores programs and others for controlling various operations of the drive source generation part 19 and the hydraulic supply part 18. The RAM 87 is used as a storage area for temporarily recording various data to be used by the CPU 85 at the execution of the foregoing programs or as a working area. Even after the power-off, the settings and flags to be held remain stored in the EEPROM 88.

The ASIC 90 generates excitation signals for distributing power to solenoids of the electromagnetic switching valves 47, 48, 76, 77, and 63, respectively, under instructions from the CPU 85. The signals are applied to drive circuits 91 to 95 corresponding to the electromagnetic switching valves 48, 47, 76, 77, and 63, respectively. The drive circuits 91 to 95 form electric signals for distributing power to the respective solenoids upon receipt of the output signals from the ASIC 90. The solenoids are excited based on the electric signals and control driving of the electromagnetic switching valve 47, 48, 76, 77, and 63, respectively.

The accumulator 75 is provided with a pressure sensor 96. The pressure sensor 96 detects the pressure accumulated in the accumulator 75 and outputs a pressure signal corresponding to the detected pressure. The pressure signal is transmitted to the CPU 85 via the ASIC 90. The controller 72 determines based on the pressure signal whether the accumulator 75 is usable (whether the sufficient pressure is accumulated). In this embodiment, when the accumulated pressure is equal to or higher than 10 MPa, the accumulator 75 is usable. However, the reference pressure used for determining whether the accumulator 75 is usable can be set as appropriate.

<Accumulated Pressure in the Accumulator and Operations of the Telescopic Boom>

In this embodiment, the pressure is accumulated in the accumulator 75 separately and independently from the operations of the telescopic boom 13.

Regardless of the presence or absence of the extension and retraction operation of the telescopic boom 13, the accumulation of pressure in the accumulator 75 is started when the accumulated pressure (the internal pressure in the accumulator 75) detected by the pressure sensor 96 is lower than a specific pressure (for example, 10 MPa). When the internal pressure in the accumulator 75 has reached a specific pressure (for example, 12 MPa), the accumulation of pressure in the accumulator 75 is stopped. Specifically, as illustrated in FIG. 7, when detecting that the internal pressure in the accumulator 75 is lower than a specific pressure based on the output signal from the pressure sensor 96, the CPU 85 switches the electromagnetic switching valve 63 (the symbol illustrated in FIG. 6 is switched) through the bus 89, the ASIC 90, and the drive circuit 95. Accordingly, the compressed air is sent to the air hose 57. As illustrated in FIG. 6, the air hose 57 is wound around the hose reel 58. The compressed air is sent to the quick release valve 56 via the air hose 57 to activate the quick release valve 56. The compressed air having passed through the quick release valve 56 reaches the AOHs 51.

With supply of the compressed air, the AOHs 51 generate a predetermined hydraulic pressure (for example, 10 MPa). That is, the AOHs 51 send high-pressure operating oil from the hydraulic output ports 53. The operating oil is sent to the accumulator 75 through the check valve 78. Accordingly, the pressure is accumulated in the accumulator 75. As described above, when the internal pressure in the accumulator 75 has reached a specific pressure, the pressure sensor 96 outputs a signal to the CPU 85, and the CPU 85 switches the electromagnetic switching valve 63 through the bus 89, the ASIC 90, and the drive circuit 95 (the symbol illustrated in FIG. 6 returns). In this embodiment, the control valve unit 55 includes the pressure control valves (the pressure-reducing valve 61 and the relief valve 62), so that the pneumatic source sends the compressed air under an appropriate pressure to the drive source generation part 19 according to the load.

In a case where the telescopic boom 13 is extended when the internal pressure in the accumulator 75 is equal to or higher than a specific pressure the B pins 26 to 30 and the C pins 34 are operated. This operation is performed in a manner described below (see FIGS. 6 and 7).

To extend the top boom 21 in the state illustrated in FIG. 2, the accumulator 75 sends the high-pressure operating oil to the hydraulic cylinder 31 or the hydraulic cylinder 35. Specifically, the electromagnetic switching valve 77 is switched (the symbol illustrated in FIG. 6 is switched) and the electromagnetic switching valves 47 and 48 are also switched (the symbols illustrated in FIG. 6 are switched). The operating oil released from the accumulator 75 is supplied to the hydraulic cylinder 31 through the check valve 49 and the electromagnetic switching valve 48. The hydraulic cylinder 31 is activated to remove the B pins 26 from the first intermediate boom 22. At this point in time, the excitation of the electromagnetic switching valve 77 is canceled (the symbol returns to the state illustrated in FIG. 6) to shut off the supply of the operating oil. Even when the supply of the operating oil is shut off, the pressure in the hydraulic cylinder 31 is maintained. In this state, as the extension cylinder 14 extends, the top boom 21 extends.

When the top boom 21 enters in the fully-extended state, the extension cylinder 14 stops. Whether the top boom 21 is in the fully-extended state can be determined by a position sensor not illustrated. Accordingly, the electromagnetic switching valve 76 is switched (the symbol illustrated in FIG. 6 is switched). In addition, the excitation of the electromagnetic switching valve 47 is canceled. Thus, the operating oil supplied to the hydraulic cylinder 31 returns to the output cylinders 68 of the AOHs 51 through the check valve 50 and the electromagnetic switching valves 48, 47, and 76. The B pins 26 are fitted to the bosses 33 to couple again the top boom 21 and the first intermediate boom 22. Subsequently, the excitation of the electromagnetic switching valves 48 and 76 is canceled (the symbol returns to the state illustrated in FIG. 6).

As described above, the air pistons 67 of the AOHs 51 are held in the freely movable state within the input cylinders 66. Thus, when the operating oil returns to the output cylinders 68, the hydraulic pistons 69 and the air pistons 67 slide together. The air in the air pistons 67 is sent to the quick release valve 56 and is discharged (released to the atmosphere) from the quick release valve 56.

Subsequently, when the internal pressure in the accumulator 75 is equal to or higher than a specific value, the electromagnetic switching valve 77 is switched (the symbol illustrated in FIG. 6 is switched) and the electromagnetic switching valve 47 is also switched (the symbol illustrated in FIG. 6 is switched). The operating oil is supplied to the hydraulic cylinder 35 through the check valve 49 and the electromagnetic switching valve 48. The hydraulic cylinder 35 is activated to remove the C pins 34 from the top boom 21. At this point in time, the excitation of the electromagnetic switching valve 77 is canceled (the symbol returns to the state illustrated in FIG. 6), but the pressure in the hydraulic cylinder 35 is kept by the electromagnetic switching valve 47 and the check valve 49. In this state, as the extension cylinder 14 retracts (see FIG. 2), the top boom 21 remains held in the fully-extended state by the first intermediate boom 22, and only the cylinder tube 36 slides toward the base end portion of the first intermediate boom 22.

When the extension cylinder 14 retracts and the C pins 34 move to the positon of the bosses 37 of the first intermediate boom 22, the extension cylinder 14 stops. Whether the C pins 34 have moved to the position of the bosses 37 of the first intermediate boom 22 can be determined by a position sensor not illustrated. Accordingly, the electromagnetic switching valve 76 is switched (the symbol illustrated in FIG. 6 is switched). In addition, the excitation of the electromagnetic switching valve 47 is cancelled. The operating oil supplied to the hydraulic cylinder 35 returns to the output cylinders 68 of the AOHs 51 through the electromagnetic switching valves 76, 48, and 47. As a result, the C pins 34 fit to the bosses 37 to couple the extension cylinder 14 to the first intermediate boom 22. Subsequently, the excitation of the electromagnetic switching valve 76 is canceled (the symbol returns to the state illustrated in FIG. 6). When the operating oil returns to the output cylinders 68, the air pistons 67 of the AOHs 51 are held in the freely movable state within the input cylinders 66, so that the hydraulic pistons 69 and the air pistons 67 slide together. The air in the air pistons 67 is sent to the quick release valve 56 and is discharged (released to the atmosphere) from the quick release valve 56.

In the same manner, the second to the fourth intermediate booms 23 to 25 are extended. In addition, as the telescopic boom 13 retracts, the hydraulic supply part 18 and the drive source generation part 19 operate in the same manner.

Figure 8:
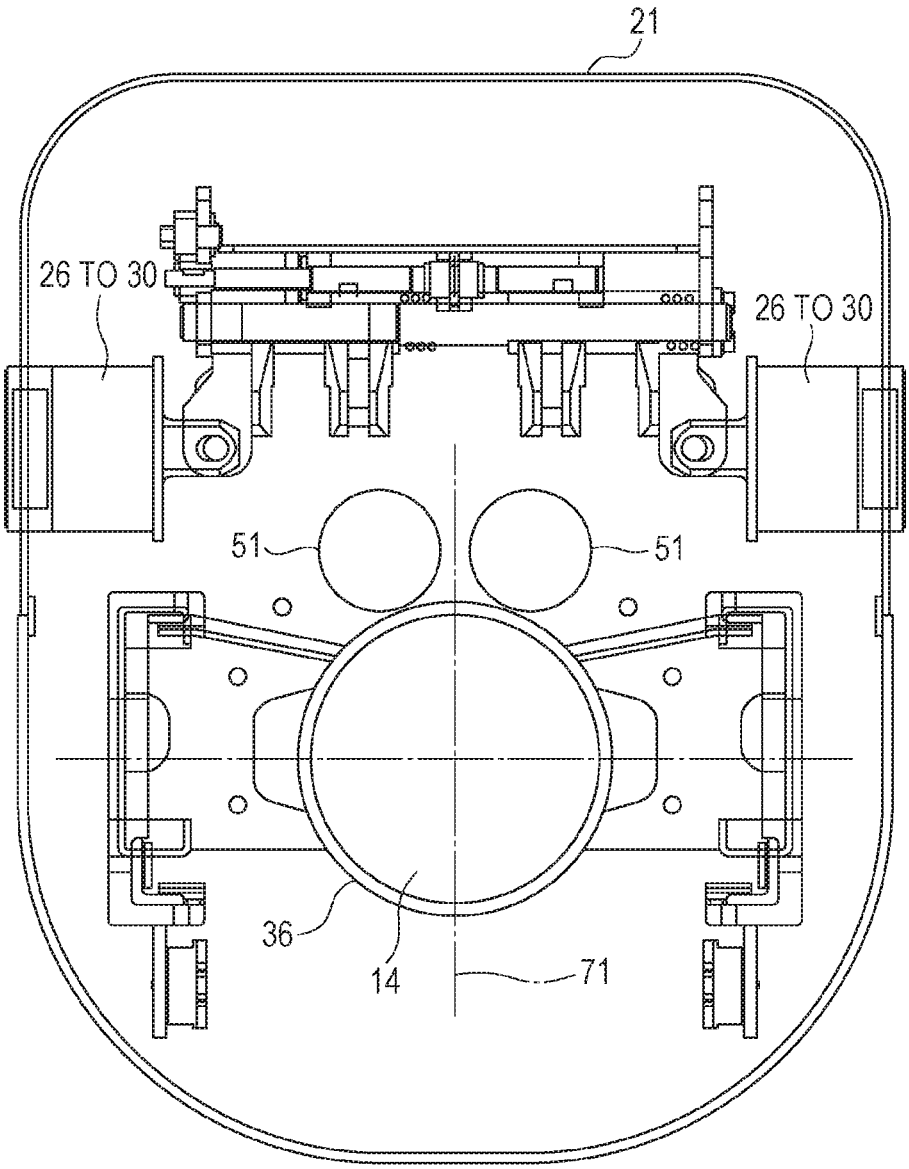
FIG. 8 is a cross-sectional view of a top boom according to the embodiment of the present invention.

FIG. 8 is a cross-sectional view of the top boom 21.

In this embodiment, the hydraulic supply part 18 includes the two AOHs 51. The AOHs 51 are arranged in the vicinity of the cylinder tube 36 of the extension cylinder 14 as illustrated in FIG. 8. These AOHs 51 are radially symmetric (bilaterally symmetric in FIG. 8) with respect to a virtual plane 71 including the center of the extension cylinder 14. Since the pair of AOHs 51 is provided, the load on each of the AOHs 51 to generate the necessary hydraulic pressure is reduced, and the AOHs 51 can be made compact and laid out between the cylinder tube 36 and the inner wall of the top boom 21 as in this embodiment. In addition, the AOHs 51 are arranged symmetrically with respect to the cylinder tube 36 to produce the advantage that the weight distribution in the telescopic boom 13 is uniform.

<Operations and Effects of the Extension Device According to This Embodiment>

According to the extension device 10 in this embodiment, the B pins 26 to 30 and the C pins 34 are driven by the accumulator 75 as a drive source, which allows the hydraulic supply part 18 to be simple and compact in structure. In addition, the pressure is accumulated in the accumulator 75 by the combined functioning of the drive source generation part 19 and the AOHs 51. Therefore, the structure of pressure accumulation is very simple as compared to the structure according to the related art in which the pressure is accumulated in the accumulator 75 by the working pressure of the extension cylinder 14.

In addition, the hydraulic supply part 18 is placed in the vicinity of the extension cylinder 14, and the circuit length of the hydraulic supply part 18 becomes very short and the reduction in operational responsiveness of the hydraulic cylinders 31 and 35 resulting from changes in the viscosity of the operating oil becomes very small. That is, the circuit length in the hydraulic system of the driving mechanism 17 is very short, so that the operational responsiveness of the cylinder-boom coupling mechanism 15 and the inter-boom fixing mechanism 16 do not decrease significantly with changes in the viscosity of the operating oil. In addition, the drive source generation part 19 supplies the compressed air to the hydraulic supply part 18. Thus, even in a case where the distance from the hydraulic supply part 18 is long, the pressure loss of the air with changes in environmental temperature is small. The operational responsiveness of the hydraulic cylinders 31 and 35 is not affected even in this case.

Therefore, the pneumatic supply part 41 in this embodiment does not need to be increased in size taking into account the pressure loss of the air but can be designed to be lightweight and small. That is, the air hose 57 can be decreased in diameter and the hose reel 58 can be designed to be compact, and thus they can be significantly small in weight as compared to the related art. As a result, the space for placement of auxiliary devices at the periphery of the turning base 11 can be wider to improve the degree of freedom in layout of the hose reel 58. In particular, as illustrated in FIG. 1, the hose reel 58 can be arranged above the turning base 11, for example, in the vicinity of the derrick central shaft 12 included in the telescopic boom 13.

In this embodiment, the accumulation of pressure in the accumulator 75 is performed separately and independently from the operation of the telescopic boom 13. That is, once the internal pressure in the accumulator 75 becomes equal to or lower than a specific value, the pressure is automatically accumulated in the accumulator 75. Therefore, the hydraulic cylinders 31 and 35 can be reliably activated when necessary.

In particular, in this embodiment, the AOHs 51 constitute a closed circuit as a hydraulic circuit, and the air pistons 67 of the AOHs 51 are arranged in the freely movable state within the input cylinders 66. For example, when the pressure of the operating oil in the hydraulic supply part 18 increases with a change in environmental temperature, since the air pistons 67 are in the freely movable state, the hydraulic pistons pairing with the air pistons 67 are easily displaced. That is, arranging the air pistons 67 in the freely movable state achieves the same function as the case where the output cylinders 68 are provided with reservoir tanks. Therefore, there is no need to provide separate reservoir tanks in the AOHs 51. As a result, it is possible to simplify the structure of the AOHs 51 and reduce the size and weight of the hydraulic supply part 18.

In this embodiment, by providing the AOH 51, the pressure in the pneumatic source is kept low, whereas the pressure accumulated in the accumulator 75 becomes high. That is, the hydraulic pressure necessary for activating the hydraulic cylinders 31 and 35 can be easily obtained. Further, in this embodiment, the pair of AOHs 51 is provided. Accordingly, the load on each of the AOHs 51 to generate the necessary hydraulic pressure becomes small, and the AOHs 51 can be made compact and laid out between the cylinder tube 36 and the inner wall of the top boom 21 as in this embodiment. In addition, the AOHs 51 are arranged symmetrically with respect to the cylinder tube 36 to produce the advantage that the weight distribution in the telescopic boom 13 is uniform. Nevertheless, a single AOH may be employed.

<Variation of This Embodiment>

Figure 9:
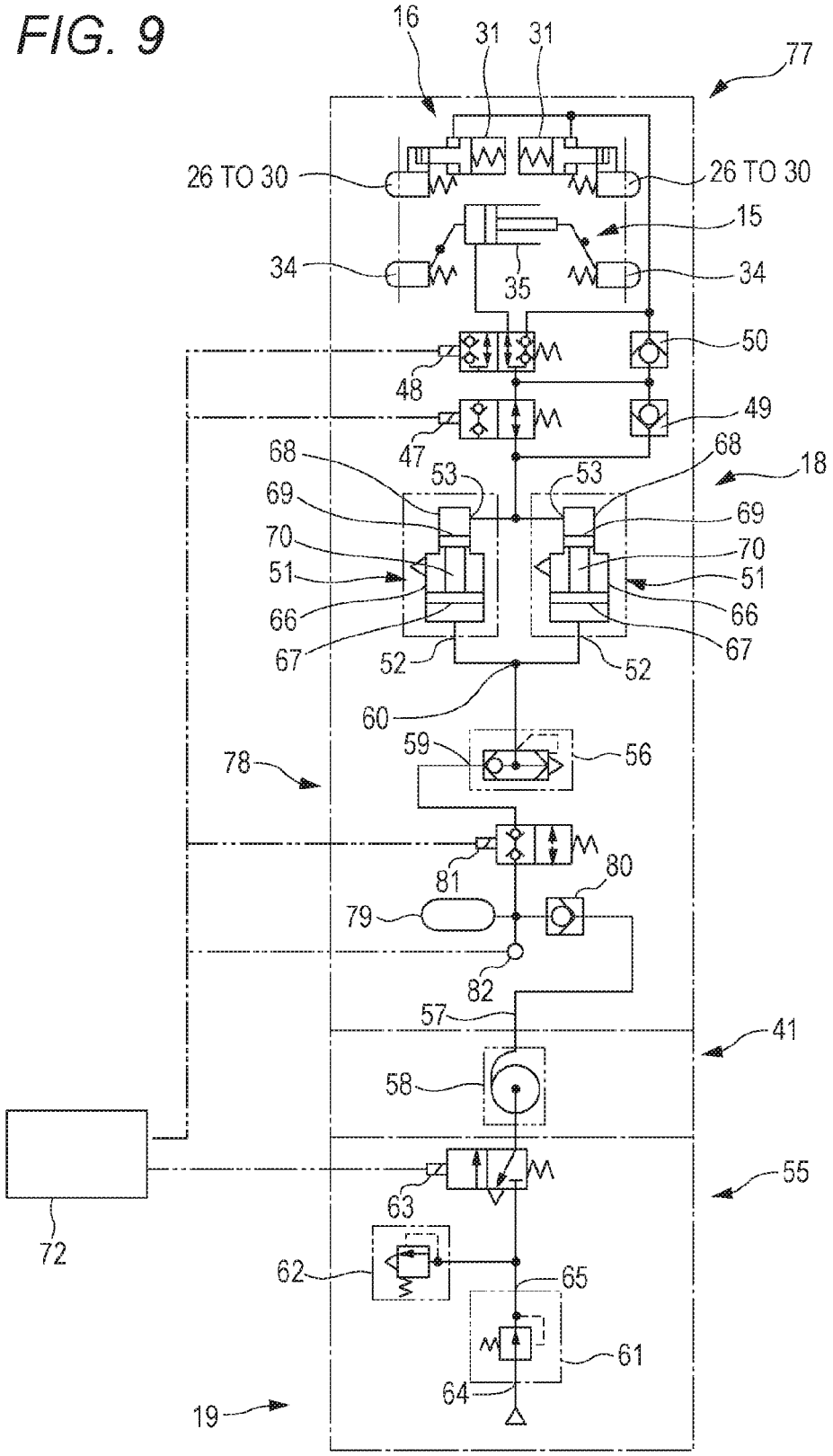
FIG. 9 is a circuit system diagram of a driving mechanism according to a variation of the embodiment of the present invention.

FIG. 9 is a circuit system diagram of a driving mechanism 77 according to a variation of this embodiment.

The driving mechanism 77 drives the cylinder boom coupling mechanism 15 and the inter-boom fixing mechanism 16 as the driving mechanism 17 does. As illustrated in FIG. 9, the driving mechanism 77 according to this variation is different from the driving mechanism 17 according to the foregoing embodiment in that the cylinder-boom coupling mechanism 15 and the inter-boom fixing mechanism 16 are driven by the hydraulic pressure output from the AOHs 51 as illustrated in FIG. 9, instead of driving the cylinder-boom coupling mechanism 15 and the inter-boom fixing mechanism 16 by the accumulator 75 (see FIG. 6), and also in that an air tank unit 78 is provided to supply the pneumatic pressure to the AOHs 51.

Specifically, in the foregoing embodiment, the accumulator 75 in which the pressure is accumulated by the AOHs 51 constitutes the drive source for the cylinder-boom coupling mechanism 15 and the inter-boom fixing mechanism 16, whereas in this variation, the AOHs 51 constitute the drive source for the cylinder-boom coupling mechanism 15 and the inter-boom fixing mechanism 16, and the air tank unit 78 is provided at the hydraulic supply part 18 to cause the AOHs 51 to discharge the oil under a predetermined pressure. The air tank unit 78 includes an air tank 79 that accumulates the compressed air, a check valve 80, an electromagnetic switching valve 81, and a pressure sensor 82. Other components of the driving mechanism 77 are the same as those of the driving mechanism 17 according to the foregoing embodiment.

Figure 10:
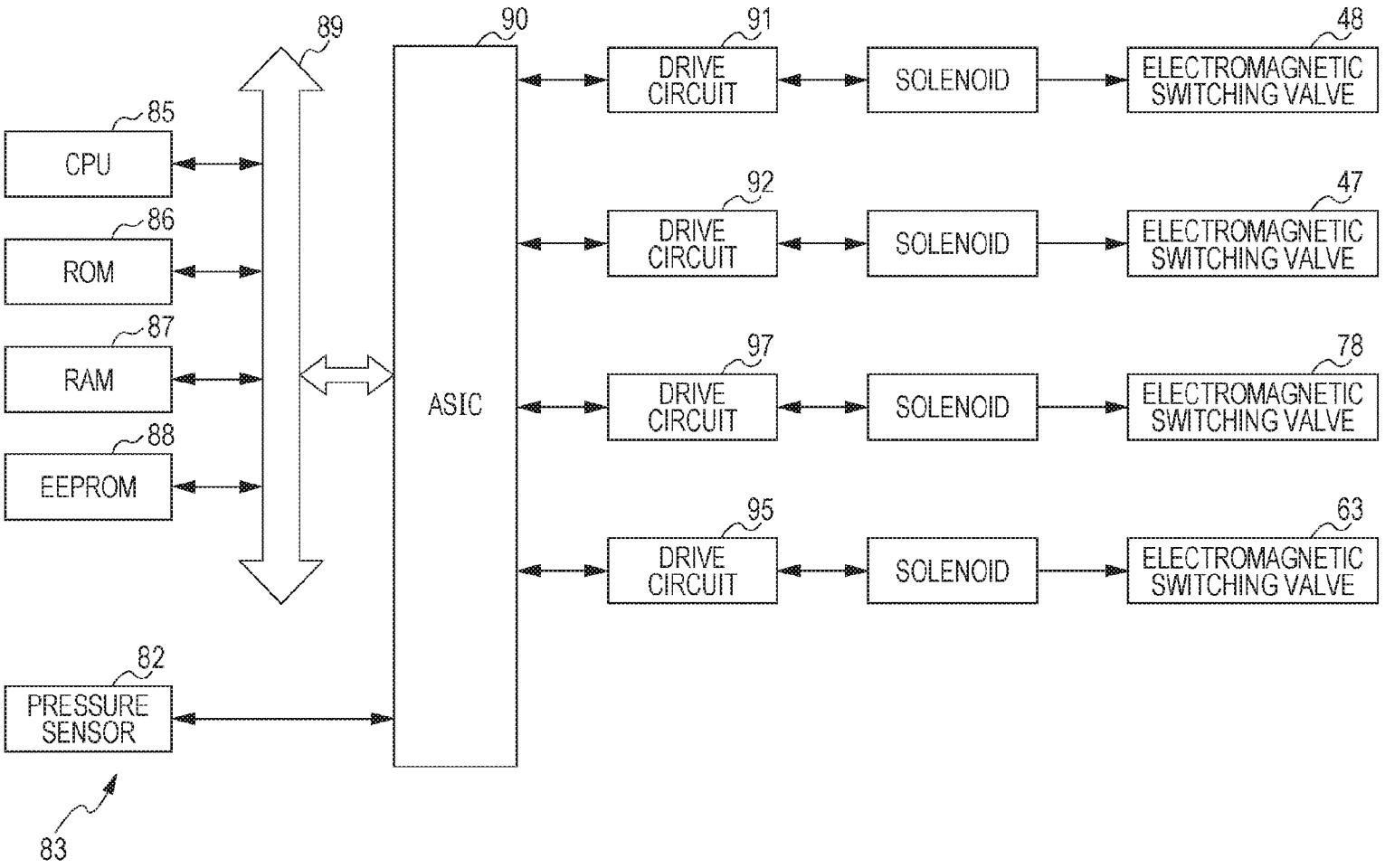
FIG. 10 is a block diagram of a controller according to the variation of the embodiment of the present invention.

According to this variation, the filling of the air tank 79 with the compressed air is performed separately and independently from the operations of the telescopic boom 13. FIG. 10 is a block diagram illustrating a configuration of a controller 83 (equivalent to a "control unit" described in the claims) according to this variation.

Regardless of the presence or absence of the extension and retraction operation of the telescopic boom 13, the filling of the air tank 79 is started when the internal pressure in the air tank 79 detected by the pressure sensor 82 is lower than a specific pressure (for example, 1 MPa). When the internal pressure has reached a specific pressure (for example, 1.2 MPa), the filling of the air tank 79 is stopped. Specifically, as illustrated in FIG. 10, when detecting that the internal pressure in the air tank 79 is lower than a specific pressure based on the output signal from the pressure sensor 82, the CPU 85 switches the electromagnetic switching valve 63 through the bus 89, the ASIC 90, and the drive circuit 95 (the symbols illustrated in FIG. 9 are switched). Accordingly, the compressed air is sent to the air hose 57. As illustrated in FIG. 9, the air hose 57 is wound around the hose reel 58. The air tank 79 is filled with compressed air through the air hose 57 and the check valve 80. The supply source for this compressed air may be a brake air tank as in the foregoing embodiment, for example. As described above, when the internal pressure in the air tank 79 has reached a specific pressure, the pressure sensor 82 outputs a signal to the CPU 85, and the CPU 85 switches the electromagnetic switching valve 63 through the bus 89, the ASIC 90, and the drive circuit 95 (the symbol illustrated in FIG. 6 returns).

When the internal pressure in the air tank 79 is equal to or higher than a specific pressure and the telescopic boom 13 is to be extended, the B pins 26 to 30 and the C pins 34 are operated. The operation is performed in a manner described below (see FIGS. 9 and 10).

When the top boom 21 in the state illustrated in FIG. 2 extends, the air tank 79 sends the compressed air to the AOHs 51. Specifically, the electromagnetic switching valve 81 is switched (the symbol illustrated in FIG. 9 is switched) and the compressed air is sent to the quick release valve 56. The compressed air activates the quick release valve 56 and reaches the AOHs 51.

The electromagnetic switching valves 47 and 48 are switched together with the electromagnetic switching valve 81 (the symbols are switched in FIG. 9). With a supply of compressed air, each of the AOHs 51 generates a predetermined hydraulic pressure (for example, 10 MPa). That is, each of the AOHs 51 sends a high-pressure operating oil from the hydraulic output port 53. The operating oil is supplied to the hydraulic cylinder 31 through the check valve 49 and the electromagnetic switching valve 48. The hydraulic cylinder 31 is activated to remove the B pins 26 from the first boom 22. At this point in time, the excitation of the electromagnetic switching valve 81 is canceled (the symbol returns to the state illustrated in FIG. 9), and the supply of the compressed air is shut off. Even when the supply of the compressed air is shut off as described above, the electromagnetic switching valve 47 and the check valve 49 keep the pressure in the hydraulic cylinder 31. As the extension cylinder 14 extends in this state, the top boom 21 extends.

When the top boom 21 is in the fully-extended state, the extension cylinder 14 stops. Accordingly, the excitation of the electromagnetic switching valve 47 is canceled (the symbols return to the states illustrated in FIG. 9). Thus, the operating oil supplied to the hydraulic cylinder 31 returns to the output cylinders 68 of the AOHs 51 through the check valve 50 and the electromagnetic switching valves 48 and 47. The B pins 26 are fitted to the bosses 33 to couple again the top boom 21 and the first intermediate boom 22. Subsequently, the excitation of the electromagnetic switching valve 48 is canceled.

As described above, the air pistons 67 of the AOHs 51 are held in the freely movable state within the input cylinders 66. Thus, when the operating oil is returned to the output cylinders 68, the hydraulic pistons 69 and the air pistons 67 slide together. The air in the air pistons 67 is sent to the quick release valve 56 and is discharged (released to the atmosphere) from the quick release valve 56.

Subsequently, the electromagnetic switching valve 81 is switched (the symbol illustrated in FIG. 9 is switched), and the compressed air reaches the AOHs 51 via the quick release valve 56. The AOHs 51 send the operating oil under a predetermined pressure from the hydraulic output ports 53.

The electromagnetic switching valve 81 and the electromagnetic switching valve 47 are switched together (the symbols are switched in the drawing). The operating oil is supplied to the hydraulic cylinder 35 through the check valve 49 and the electromagnetic switching valve 48. The hydraulic cylinder 35 is activated to remove the C pins 34 from the top boom 21. At this point in time, the excitation of the electromagnetic switching valve 81 is canceled and the supply of the compressed air is shut off. Even when the supply of the compressed air is shut off as described above, the electromagnetic switching valve 47 and the check valve 49 keep the pressure in the hydraulic cylinder 35. In this state, as the extension cylinder 14 retracts (see FIG. 2), the top boom 21 remains held in the fully-extended state by the first intermediate boom 22, and only the cylinder tube 36 slides toward the base end portion of the first intermediate boom 22.

When the extension cylinder 14 retracts and the C pins 34 move to the positon of the bosses 37 of the first intermediate boom 22, the extension cylinder 14 stops. Accordingly, the excitation of the electromagnetic switching valve 47 is cancelled. The operating oil supplied to the hydraulic cylinder 35 returns to the output cylinders 68 of the AOHs 51 through the electromagnetic switching valves 48 and 47. As a result, the C pins 34 fit to the bosses 37 and the extension cylinder 14 is coupled to the first intermediate boom 22. When the operating oil returns to the output cylinder 68, since the air pistons 67 of the AOHs 51 are held in the freely movable state within the input cylinders 66, the hydraulic pistons 69 and the air pistons 67 slide together. The air in the air pistons 67 is sent to the quick release valve 56 and is discharged (released to the atmosphere) from the quick release valve 56.

In the same manner, the second to the fourth intermediate booms 23 to 25 are extended. In addition, as the telescopic boom 13 retracts, the hydraulic supply part 18 and the drive source generation part 19 operate in the same manner.

In this variation, the B pins 26 to 30 and the C pins 34 are driven by the AOHs 51 using the air tank 79 as a drive source. That is, the B pins 26 to 30 and the C pins 34 are driven by the combined functioning of the pneumatic mechanism and the hydraulic mechanism. In addition, the air tank 79 is provided at the hydraulic supply part 18, and the structure of pressure accumulation is very simple as compared to the structure according to the related art in which the pressure is accumulated in the accumulator by the working pressure of the extension cylinder 14.

What is claimed is:

1. A telescopic boom extension device applied to a telescopic boom in which a base boom, an intermediate boom inserted into the base boom, and a top boom inserted into the intermediate boom constitute a telescopic structure, a boom fixing member is provided to couple an adjacent pair of the booms when the adjacent booms are in a fully-extended state or a fully-contracted state, and when a single built-in extension cylinder extends or retracts, the extension cylinder is coupled selectively to the top boom and the intermediate boom in sequence via a cylinder fixing member to extend the top boom and the intermediate boom in sequence, the telescopic boom extension device comprising:

a hydraulic supply part that includes: an accumulator configured to supply operating oil under a predetermined pressure to a first hydraulic actuator and a second hydraulic actuator; and an air over hydraulic booster (AOH) configured to accumulate pressure in the accumulator, the first and the second hydraulic actuators being configured to drive the boom fixing member and the cylinder fixing member, respectively, the hydraulic supply part being placed in the vicinity of the extension cylinder; and a drive source generation part that includes a pneumatic supply part configured to supply a pneumatic pressure and that is configured to generate operating oil under a predetermined pressure at the hydraulic supply part based on the pneumatic pressure.

2. The telescopic boom extension device according to claim 1, further comprising:

a pressure sensor configured to detect internal pressure in the accumulator; and a control unit configured to operate the drive source generation part to activate the AOH, when determining that the internal pressure is equal to or lower than a specific value based on an output signal from the pressure sensor.

3. The telescopic boom extension device according to claim 1, wherein the AOH includes an air cylinder including an air piston and an air tube, wherein the air piston is slidable relative to the air tube without being biased in any direction.

4. A telescopic boom extension device applied to a telescopic boom in which a base boom, an intermediate boom inserted into the base boom, and a top boom inserted into the intermediate boom constitute a telescopic structure, a boom fixing member is provided to couple an adjacent pair of the booms when the adjacent booms are in a fully-extended state or a fully-retracted state, and when a single built-in extension cylinder extends or retracts, the extension cylinder is coupled selectively to the top boom and the intermediate boom in sequence via a cylinder fixing member to extend the top boom and the intermediate boom in sequence, the telescopic boom extension device comprising:

a hydraulic supply part that includes: an air over hydraulic booster (AOH) configured to supply operating oil under a predetermined pressure to a first hydraulic actuator and a second hydraulic actuator; and an air tank unit configured to supply compressed air to the AOH, the first and the second hydraulic actuators being configured to drive the boom fixing member and the cylinder fixing member, respectively, the hydraulic supply part being placed in the vicinity of the extension cylinder; and a drive source generation part that includes a pneumatic supply part configured to supply a pneumatic pressure and that is configured to fill the air tank unit with compressed air based on the pneumatic pressure.

5. The telescopic boom extension device according to claim 4, further comprising:

a pressure sensor configured to detect a filling pressure in the air tank unit; and a control unit configured to, operate the drive source generation part to fill the air tank unit with compressed air, when determining that the filling pressure is equal to or lower than a specific value based on an output signal from the pressure sensor.

6. The telescopic boom extension device according to claim 4, wherein the AOH includes an air cylinder including an air piston and an air tube, wherein the air piston is slidable relative to the air tube without being biased in any direction.

* * * * *